US005372440A

United States Patent [19]

Slater

[11] Patent Number: 5,372,440

[45] Date of Patent: Dec. 13, 1994

[54] PRINTING MACHINES

[75] Inventor: David G. Slater, East Grinstead, England

[73] Assignee: ITW Limited, Windsor, England

[21] Appl. No.: 17,910

[22] Filed: Feb. 16, 1993

[30] Foreign Application Priority Data

Feb. 13, 1992 [GB] United Kingdom ..... 9203047

[51] Int. Cl.[5] ..... B41J 25/304

[52] U.S. Cl. ..... 400/320; 400/120.16; 400/328; 400/355; 400/356; 400/322

[58] Field of Search ..... 400/120, 320, 320.1, 400/322, 328, 355, 356

[56] References Cited

U.S. PATENT DOCUMENTS 4,874,264 10/1989 Suzuki et al. ..... 400/322
5,090,829 2/1992 Lee et al. ..... 400/322
5,158,379 10/1992 Moriya et al. ..... 400/279

FOREIGN PATENT DOCUMENTS 0118175 5/1991 Japan ..... 400/120

*Primary Examiner*—David A. Wiecking
*Assistant Examiner*—Lynn D. Hendrickson
*Attorney, Agent, or Firm*—Schwartz & Weinrieb

[57] ABSTRACT

A printing machine wherein printing onto a substrate is effected by a first movement of a print head (1) downwardly into contact with the substrate and then by a second movement over the surface of the substrate while thermal printing elements within the print head (1) are selectively energized. The first movement is controlled by downward movement of a pair of rollers (6,7) operated by synchronized angular movement of a pair of eccentric shafts (8,9) one of which is freely mounted within each roller (6,7). The first and second movements are driven by a first and second stepper motor respectively. The rollers may be coupled by drive belts (4,5).

18 Claims, 8 Drawing Sheets

PRINTING MACHINES

FIELD OF THE INVENTION

This invention is concerned with the provision of a printing machine and more particularly with the provision of a flat bed thermal printing machine using a matrix of dots to form letters and/or symbols and devices.

BACKGROUND OF THE INVENTION

Thermal printers have become popular during the last ten years or so and, broadly speaking, two types of thermal printers are now available. A first type of printer uses a thermally sensitive substrate on which to print, and a second type of printer uses a conventional substrate with a thermally sensitive ribbon interposed between a print head and the substrate. A machine in accordance with this invention may be used with either type of thermal printer but we prefer to use a printer of the second type which uses a thermally sensitive ribbon in combination with a conventional substrate.

It is an important feature of the invention that the machine is a flat bed printer so that the substrate is in a substantially flat position during the printing operation.

One advantage of flat bed printing as compared with printers in which a print head operates against a platen in the form of a roller is that a flat bed printer may more easily be used to print onto a relatively inflexible substrate which is difficult to bend around a platen in the form of a roller. On the other hand there is a problem with flat bed printing in that printing may be carried out over a relatively large flat area and in order to achieve a good printing result over the whole area it is important to make sure, as far as it is possible to do so, that the print head applies a predetermined required pressure to the substrate over the whole printing area while the substrate is sandwiched between the print head and the flat bed or platen of the printer.

OBJECT OF THE INVENTION

It is an object of the present invention to provide improved means for moving the print head during printing in order to produce a thermal printer which can operate at very high speed, which can effect printing of high quality and uniform density, and which is less expensive to produce than other printers.

SUMMARY OF THE INVENTION

According to the present invention there is provided a printing machine wherein printing onto a substrate is effected by a first movement of a print head from an inoperative position downwardly to an operative position in contact with the substrate, and then by a second movement over the surface of the substrate while thermal printing elements in the print head are selectively energised, characterised in that the first movement of the print head is achieved by downward movement of a pair of rollers operated by synchronised angular movement of a pair of eccentric shafts one of which is freely mounted within each roller in such a way to be driven by a first stepper motor, and further characterised in that the second movement of the print head is achieved by rotation of the same pair of rollers relative to the eccentric shafts under the influence of a second stepper motor.

The invention also includes a flat bed thermal printing machine adapted to print information onto an elongate substrate disposed at a printing site within the machine, the substrate being movable through the machine in a step by step movement with a stop for printing between steps when the substrate is disposed in a substantially flat position at the printing site wherein the machine comprises a print head normally disposed out of contact with the substrate and provided with a multiplicity of individually energisable dot type thermal elements, means to selectively energise the thermal elements, first moving means to move the print head from its normal position towards and into contact with the substrate for printing and to move it back again to its normal position, second moving means to move the print head over the surface of the substrate while the thermal elements are selectively energised so as to effect printing while the substrate is stationary at the printing site between the stepwise movements, characterised in that the first moving means includes a pair of eccentric shafts each rotatable within a roller, a pair of print head driving belts interconnecting the rollers and a first stepper motor to rotate the eccentric shafts relative to the rollers so that in operation as the eccentric shaft rotate within the rollers, the print head is pushed upwards and downwards by the rollers, and further characterised in that the second moving means includes a second stepper motor arranged to drive one of the rollers around its eccentric shaft, the other roller being driven by the print head driving belts, the arrangement being such that both the up and down movements and the backwards and forwards movements of the print head are achieved by movement of the rollers.

It is important that the driving belts do not slip, and for that reason we prefer to use toothed belts to engage with toothed rollers. In this specification we shall assume that the machine is in an upright position and so from time to time we shall refer to the movement of the print head toward and away from the substrate as being an up and down movement.

It will be understood from the above that the underlying idea of the invention is to carefully control the up and down movement and the side to side movement of the print head. The print head may be attached to a carriage which in turn may be attached to two bottom guide members and to the pair of toothed belts which mesh with the pair of toothed rollers. As the rollers rotate, the print head is moved from side to side, that is, is pushed backwards and forwards across the substrate. The carriage is also preferably attached to two top guide members similar to the bottom members but the top guide members are not connected to the belts so that the belts run freely relative to the top guide members which simply run against the belts as the carriage moves. The print head is moved upwardly and downwardly relative to the substrate, for example, the head is raised and lowered by rotation of the eccentric shafts inside the rollers which are free for angular displacement relative to the shafts. The eccentric shafts are arranged in pairs which are linked together by an arrangement of belts and pulleys so as to ensure that the print head is moved substantially parallel to the flat bed or platen by keeping the eccentric shafts in phase. The movement of the print head toward and away form the flat bed or platen is achieved by the use of the first stepper motor which directly drives one of the eccentric shafts, and as a consequence of the toothed belts, drives the other eccentric shaft.

BRIEF DESCRIPTION OF THE DRAWINGS

In order that the invention may be more clearly understood from the following detailed description, reference is also directed to the accompanying drawings, given by way of example, which show various views of a printing machine in accordance with the invention using a thermally sensitive printing ribbon, in which like reference characters designate like or corresponding parts throughout the several views, and wherein.

DETAILED DESCRIPTION OF THE PREFERRED EMBODIMENT

Figure 1:
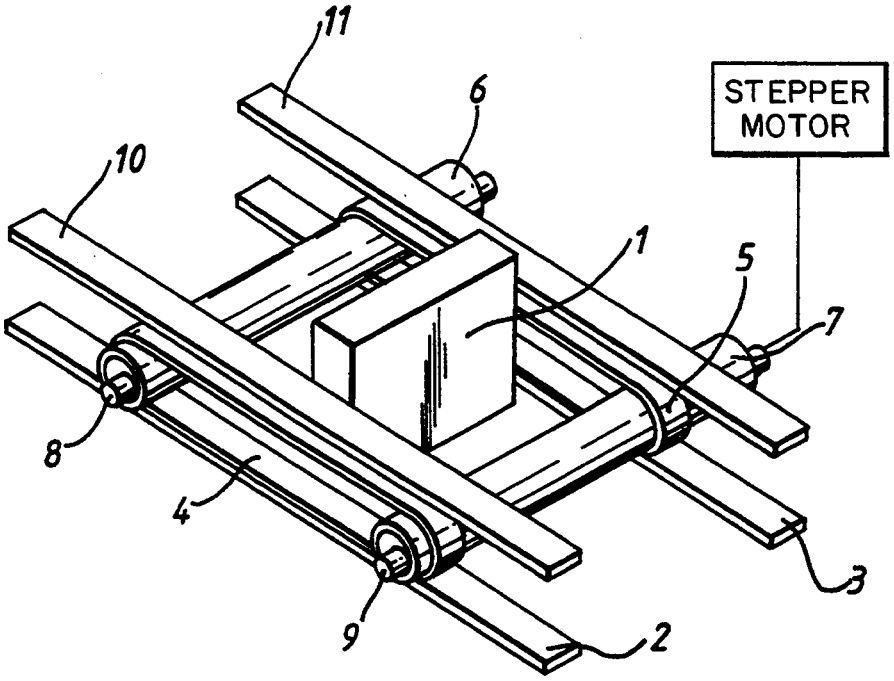
FIG. 1 is a perspective view of a mechanism to raise and lower the print head of the printing machine.
Figure 2:
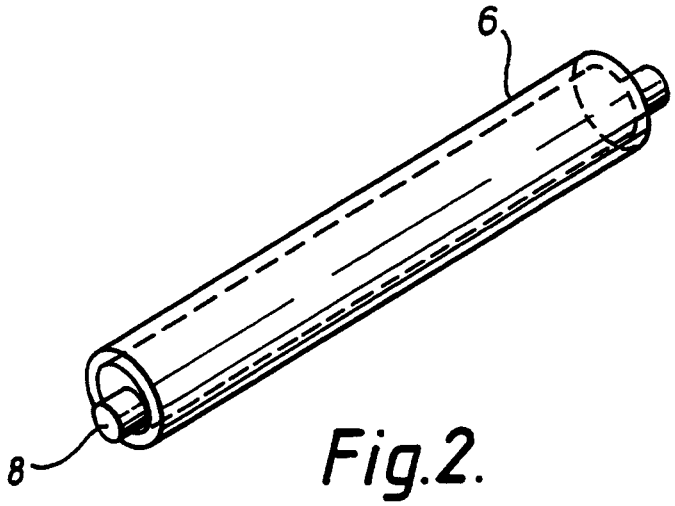
FIG. 2 is a detailed view of one of the eccentric shafts inside a toothed roller.
Figure 3:
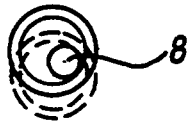
FIG. 3 is a detailed end view of one of the eccentric shafts showing in full lines the raised position and in dash lines the lowered position.

The printing machine shown in the drawings is designed to print onto a substrate disposed upon a flat bed. Printing is effected by transferring ink from a ribbon onto the substrate using a thermal print head which employs a multiplicity of individual heating elements adapted to be selectively energised so as to produce a fine deposition of ink from the ink carrying ribbon onto the substrate.

Figure 4:
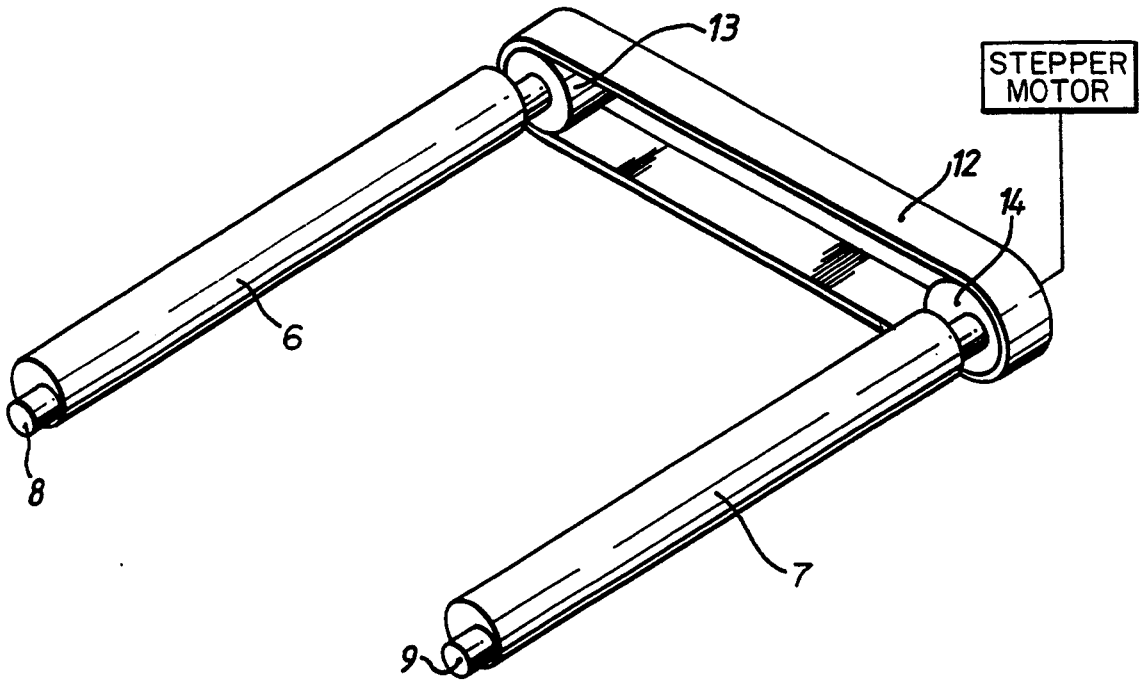
FIG. 4 is a perspective view showing part of the mechanism provided to keep the rotation of the eccentric shafts in phase.
Figure 5:
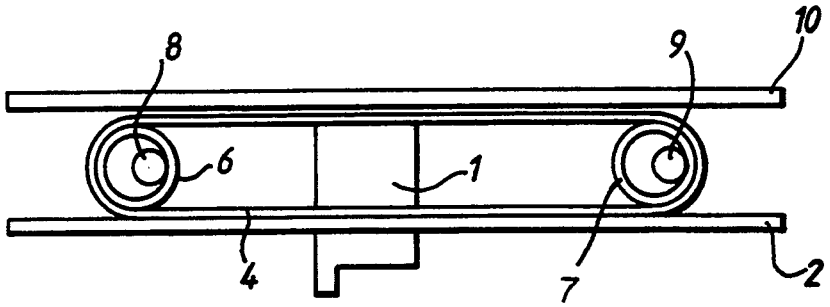
FIG. 5 is an end view of the eccentric shafts and toothed rollers with top and bottom guides in position.

In the embodiment illustrated the print head is positioned above the ribbon and substrate, and when not printing, the head is spaced apart from the ribbon in its normal or inoperative position and so the head, when in its normal or inoperative position, applies no pressure to the ribbon or to the substrate, both the ribbon and the substrate being free to move relative to each other and to the print head. The flat bed or platen, which may be coated with rubber or the like is disposed below the substrate and remains in a substantially static position during the operation of the machine although, if desired the flat bed may be spring mounted so as to be self-adjusting. For printing purposes the ribbon and substrate must be sandwiched between the print head and the flat bed and the print head must be moved downwardly into contact with the ribbon so as to apply a predetermined pressure to the ribbon and substrate. During printing the required pressure or load must be maintained so as to grip the ribbon and substrate and to ensure good print quality. Up and down movement of the print head is effected by the provision of a stepper motor which is schematically shown in FIGS. 1 and 4.

Up and down movement of carriage and print head

Referring now particularly to FIG. 1, the print head is connected to a print head carriage, the head and carriage being indicated generally in FIG. 1 by the reference 1. In turn the carriage is connected to a print head moving mechanism adapted to move the print head up and down substantially in a vertical plane. The carriage is connected to two bottom guides 2 and 3 and to two toothed print head driving belts 4 and 5 riding on toothed rollers 6, 7, mounted on eccentric shafts 8 and 9 so that in operation, as the eccentric shafts rotate, the head is pushed upwards and downwards. Top guides 10 and 11 are also provided and are connected to the carriage but the top guides 10, 11 are not connected to the print head driving belts 4, 5 so that the top guides 10, 11 simply rub against the belts 4,5 as the print head and carriage 1 move. It will be understood from the above that the print head and carriage 1 are raised and lowered by rotation of the eccentric shafts 8, 9 inside the rollers 6, 7, which are free to rotate around the shafts 8, 9. The eccentric shafts 8, 9 are linked together using a toothed belt 12 and toothed pulleys 13, 14 as shown in FIG. 4. To ensure that the print head is move in a plane substantially parallel to the plane of the flat bed the eccentric shafts 8, 9 are kept in phase during their movements. The print head 1 is driven up and down by a stepper motor, schematically shown in FIGS. 1 and 4, which drives the eccentric shaft 9 and by means of pulleys 13 and 14 and belt 12, see FIG. 4, drives the other eccentric shaft 8.

Backwards and forwards movement of the print head and carriage

Figure 6:
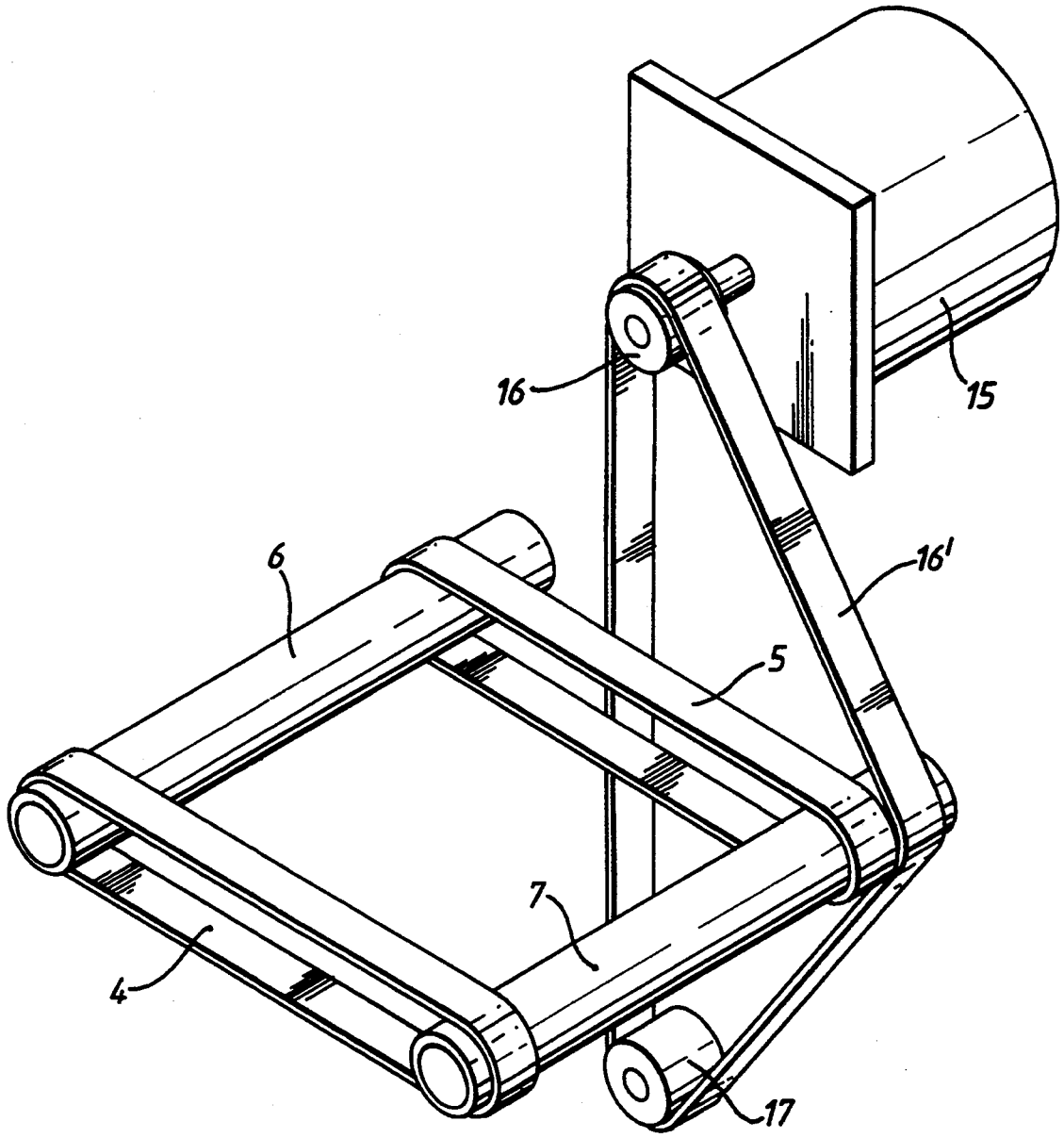
FIG. 6 is a perspective view showing part of the drive mechanism for the print head.
Figure 7:
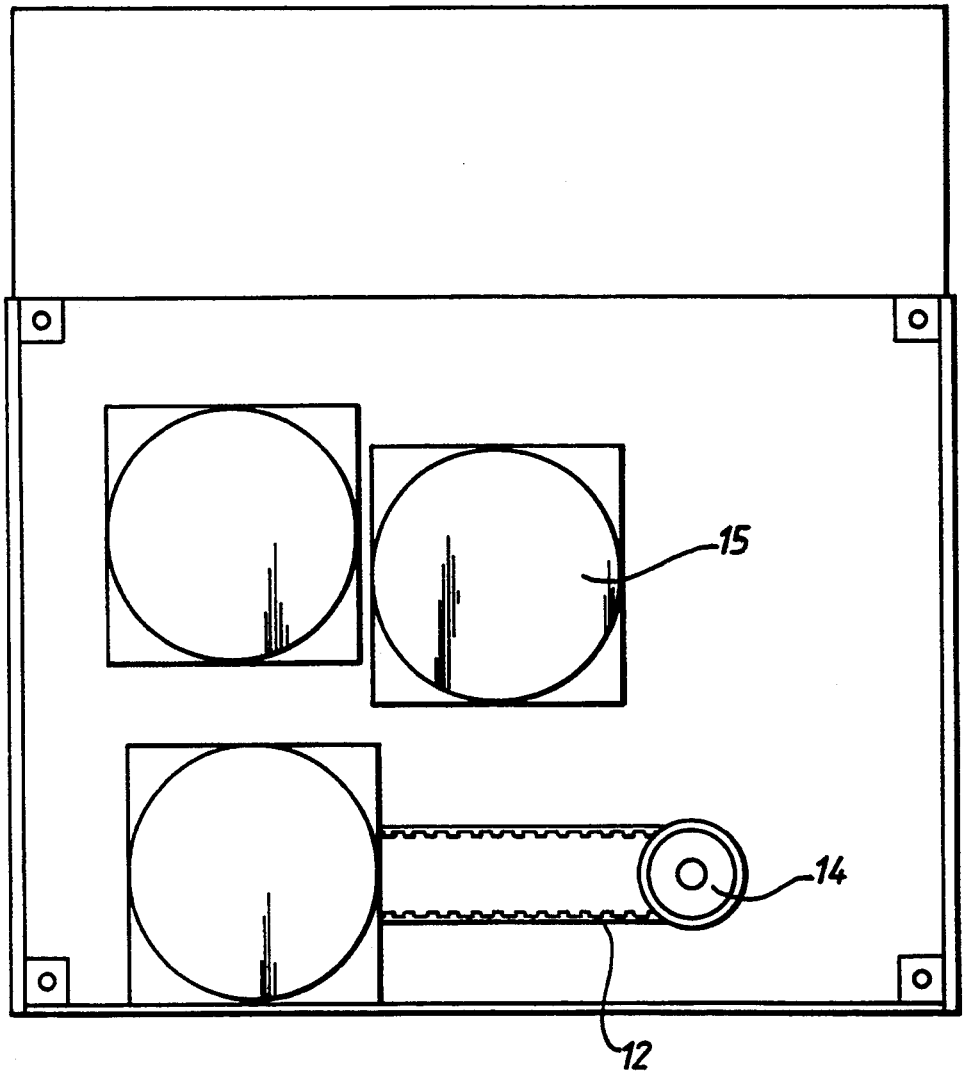
FIG. 7 is a rear elevation view of a machine in accordance with the invention.
Figure 8:
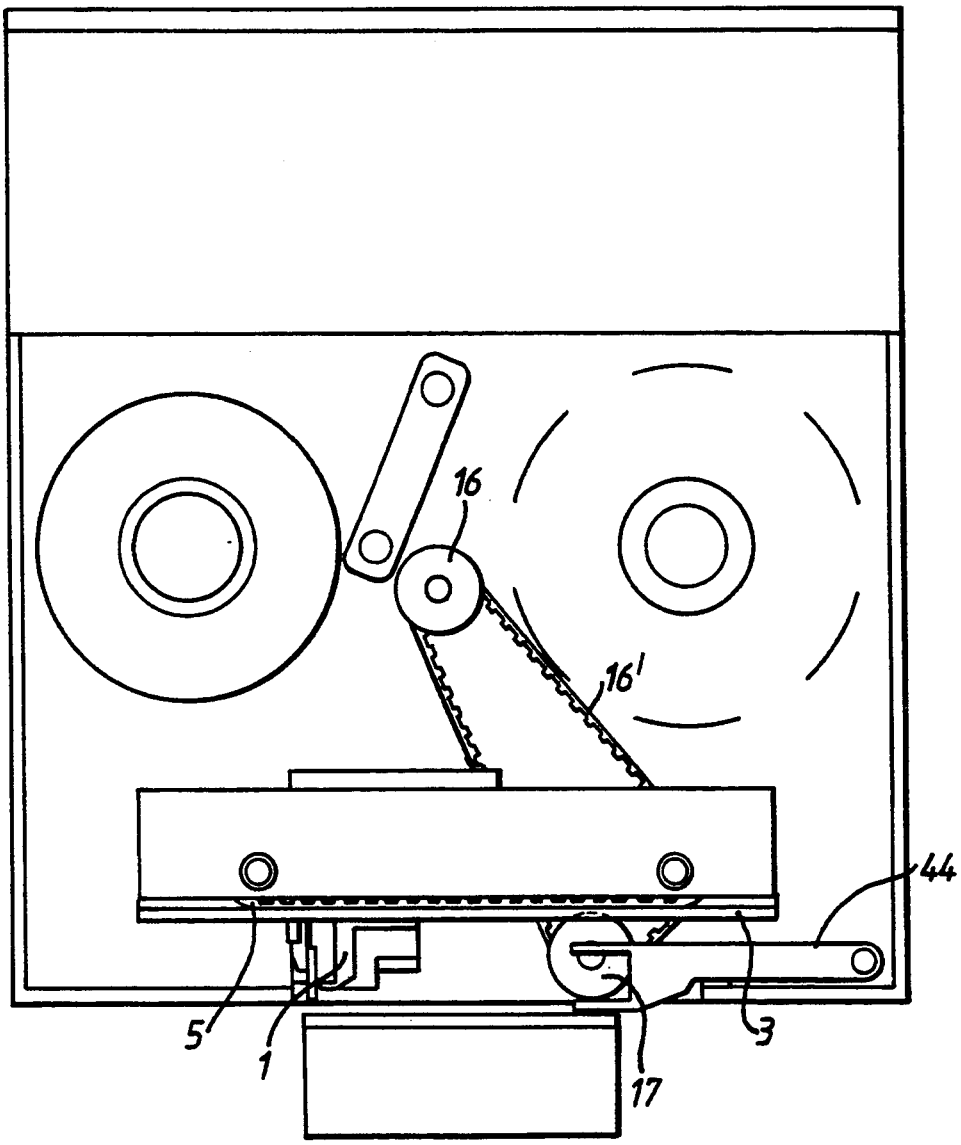
FIG. 8 is a front elevation view of the machine shown in FIG. 7.
Figure 9:
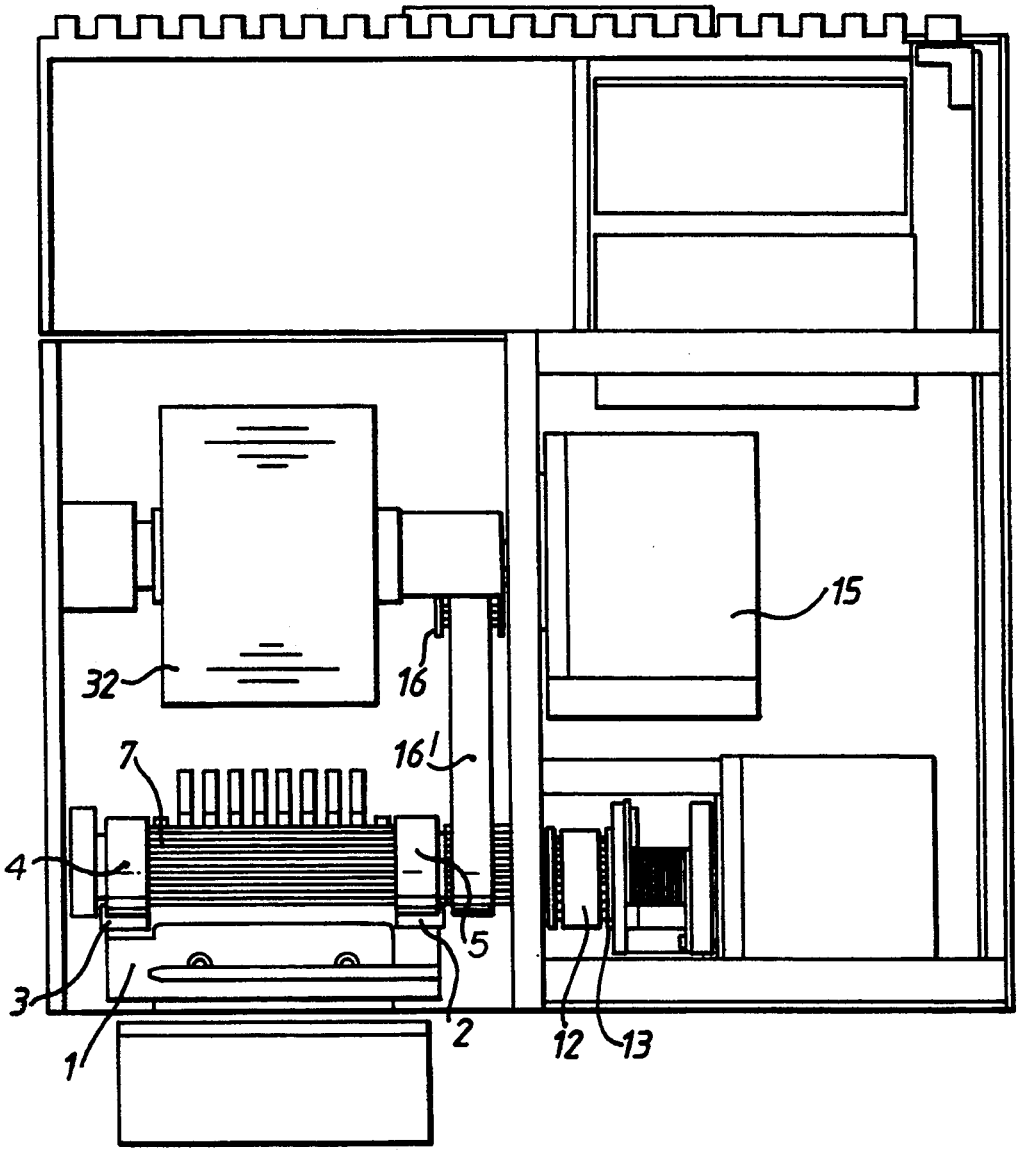
FIG. 9 is a side elevation view of the machine shown in FIG. 7.
Figure 10:
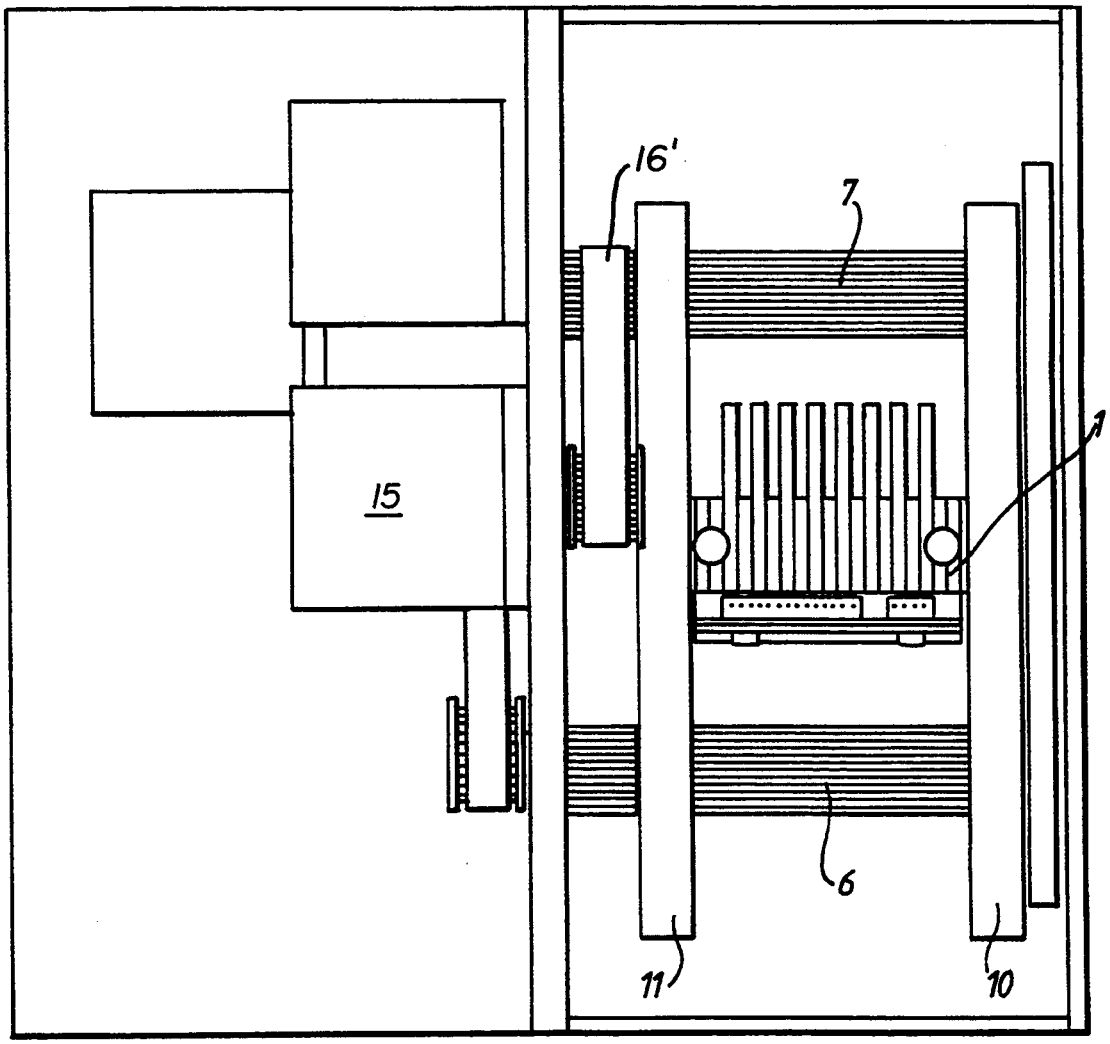
FIG. 10 is a top plan view of the machine shown in FIG. 7.
Figure 11:
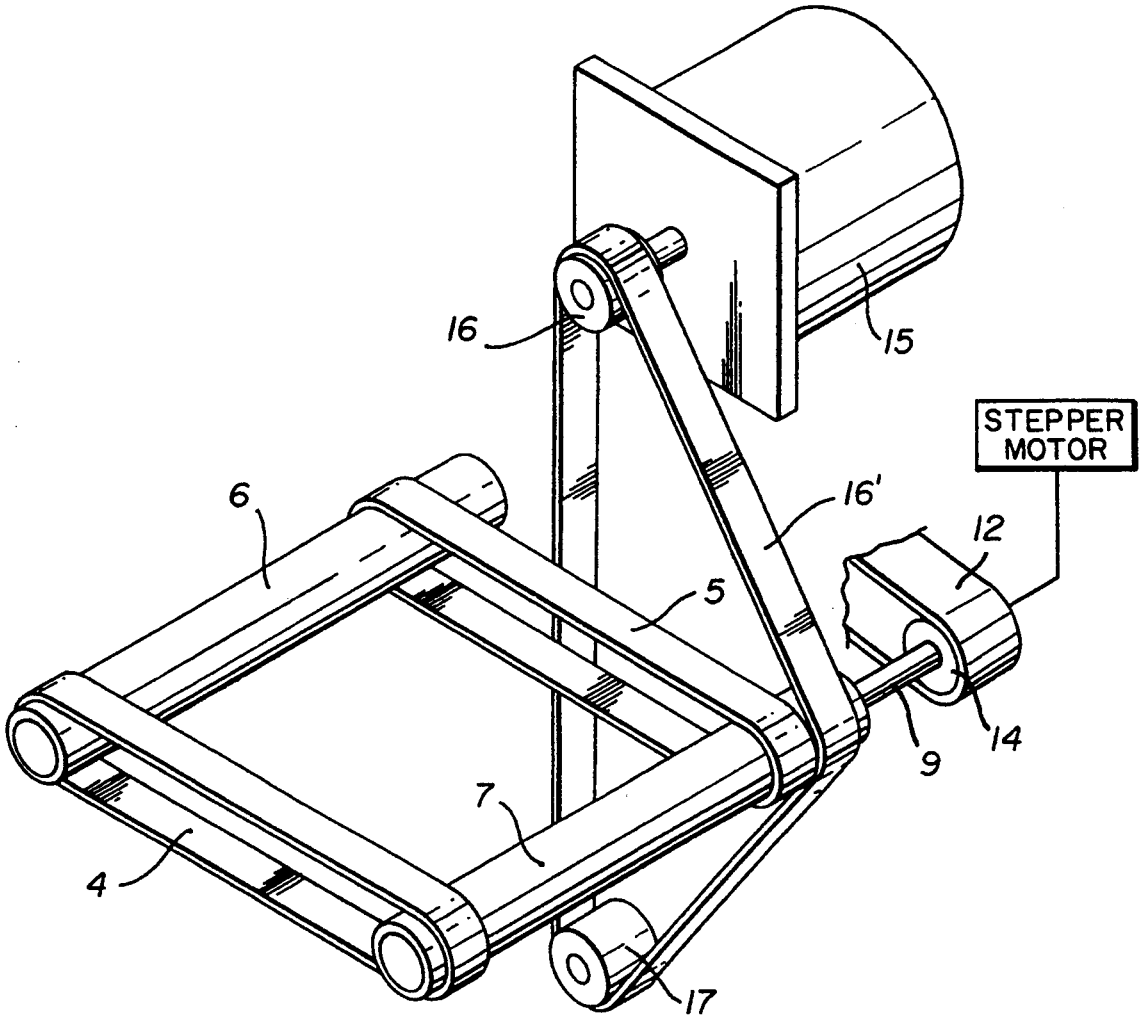
FIG. 11 is a perspective view of a combined drive system of the present invention for driving the eccentric shafts and rollers for moving the print head.

The print head 1 is driven forwards and backwards using a second stepper motor 15 (FIG. 6) which drives one of the toothed rollers 7 by means of a toothed pulley 16 and a toothed belt $16^1$. An idler pulley 17 is also provided to maintain tension on the belt $16^1$. Only one of the rollers, that is roller 7 is driven directly by the stepper motor 15, the second roller 6 being driven from the first roller 7 through means of the toothed belts 4, 5.

The idler pulley 17 is positioned to minimize any change in length of the path of the drive belt $16^1$ as the eccentric shafts 8 and 9 rotate to raise and lower the print head.

When the machine is operating the print head and carriage 1 are moved up and down and backwards and forwards using the two stepper motors as described above. The movements of the print head are synchronised with the energisation of the thermal elements and with the movement of the ribbon and substrate which are moved into printing position over the flat bed and are then momentarily stopped while the print head sweeps over the surface of the substrate and ribbon with selectively energised thermal elements to effect printing. Details of the electronic circuitry to move the various parts of the machine and to energise the thermal elements are not included because the circuitry is now conventional and will be well understood by someone skilled in the art. The ribbon used for printing is supplied on a reel, one end of which may be shaped to fit a drive dog connected to a third stepper motor, the operation of which is synchronised with that of the other two stepper motors.

FIGS. 7, 8, 9 and 10 show various views of a machine constructed in accordance with the invention using the mechanism illustrated in FIGS. 1 to 6.

I claim:

1. Printing apparatus for printing onto a substrate, comprising:

a print head, having printing elements disposed therein, movable in a substantially vertical direction between a first, inoperative, raised position at which said print head is spaced from said substrate, and a second operative, lowered position at which said print head is disposed in contact with said substrate so as to effect printing thereon by means of said printing elements thereof; said print head also being movable in a substantially horizontal direction with respect to said substrate so as to move across a predetermined region of said substrate in order to effect said printing thereon;

a pair of rollers wherein each roller has a longitudinal axis;

means interconnecting said pair of rollers to said print head;

first drive means operatively connected to said pair of rollers for moving said pair of rollers in said substantially vertical direction so as to, in turn, move said print head in said substantially vertical direction between said first, inoperative, raised position and said second, operative, lowered position; and second drive means operatively connected to said pair of rollers for rotating said pair of rollers about their respective longitudinal axes so as to move said print head in said substantially horizontal direction relative to said substrate in order to effect a predetermined printing pattern upon said substrate by said printing elements of said print head.

2. Flat bed printing apparatus for printing information onto an elongated substrate at a printing region within said apparatus, wherein said substrate is movable through said apparatus in a step-by-step manner and stopped, for having a printing operation performed thereon, between steps of said step-by-step movement when said substrate is disposed in a substantially flat position at said printing region of said apparatus, comprising:

a print head, having printing elements disposed therein, movable in a substantially vertical direction between a first, inoperative raised position at which said print head is spaced from said substrate, and a second, operative lowered position at which said print head is disposed in contact with said substrate so as to effect printing thereon by means of said printing elements thereof; said print head also being movable in a substantially horizontal direction with respect to said substrate so as to move across a predetermined region of said substrate in order to effect said printing thereon;

a pair of rollers wherein each roller has a longitudinal axis;

means interconnecting said pair of rollers to said print head;

first drive means operatively connected to said pair of rollers for moving said pair of rollers in said substantially vertical direction so as to, in turn, move said print head in said substantially vertical direction between said first, inoperative, raised position and said second, operative, lowered position; and second drive means operatively connected to said pair of rollers for rotating said pair of rollers about their respective longitudinal axes so as to move said print head in said substantially horizontal direction relative to said substrate in order to effect a predetermined printing pattern upon said substrate by said printing elements of said print head.

3. The apparatus as set forth in claim 1, wherein:

said print head comprises a thermal print head; and said printing elements are thermal printing elements which are individually energizable so as to effect said predetermined printing pattern upon said substrate.

4. The apparatus as set forth in claim 1, wherein:

said means interconnecting said pair of rollers to said print head comprises a pair of print head driving belts disposed about said pair of rollers and fixedly connected to said print head.

5. The apparatus as set forth in claim 1, wherein said first drive means comprises:

a pair of rotary shafts eccentrically mounted respectively within said pair of rollers; and a drive belt operatively interconnecting said pair of rotary shafts; and a first stepper motor drivingly connected to a first one of said pair of rotary shafts for driving said first one of said rotary shafts, said first one of said rotary shafts driving, in turn, a second one of said pair of rotary shafts by means of said drive belt.

6. The apparatus as set forth in claim 4, wherein:

said second drive means comprises a second stepper motor drivingly connected to a first one of said pair of rollers for driving said first one of said pair of rollers, said first one of said pair of rollers driving, in turn, a second one of said pair of rollers by means of said pair of print head driving belts.

7. The apparatus as set forth in claim 4, wherein:

outer peripheral portions of said pair of rollers are toothed; and said pair of print head driving belts are toothed so as to engage said toothed portions of said pair of rollers.

8. The apparatus as set forth in claim 5, wherein:

said pair of rotary shafts are respectively provided with toothed pulleys; and said drive belt comprises a toothed drive belt for engaging said toothed pulleys of said pair of rotary shafts.

9. The apparatus as set forth in claim 2, further comprising:

a flat bed or platen for operatively supporting said substrate within said printing region of said apparatus.

10. The apparatus as set forth in claim 2, wherein:

said print head comprises a thermal print head; and said printing element comprise dot-type thermal printing elements which are individually energizable so as to effect said predetermined printing pattern upon said substrate.

11. The apparatus as set forth in claim 2, wherein said first drive means comprises:

a pair of rotary shafts eccentrically mounted respectively within said pair of rollers;

a drive belt operatively interconnecting said pair of rotary shafts; and a first stepper motor drivingly connected to a first one of said pair of rotary shafts for driving said first one of said pair of rotary shafts, said first one of said pair of rotary shafts driving, in turn, a second one of said pair of rotary shafts by means of said drive belt.

12. The apparatus as set forth in claim 2, wherein:

said means interconnecting said pair of rollers to said print head comprises a pair of print head driving belts disposed about said pair of rollers and fixedly connected to said print head.

13. The apparatus as set forth in claim 12, wherein:

said second drive means comprises a second stepper motor drivingly connected to a first one of said pair of rollers for driving said first one of said pair of rollers, said first one of said pair of rollers driving, in turn, a second one of said pair of rollers by means of said pair of print head driving belts.

14. The apparatus as set forth in claim 12, wherein:

outer peripheral portions of said pair of rollers are toothed; and said pair of print head driving belts are toothed so as to engage said toothed portions of said pair of rollers.

15. The apparatus as set forth in claim 11, wherein:

said pair of rotary shafts are provided respectively with toothed pulleys; and said drive belt comprises a toothed drive belt for engaging said toothed pulleys of said pair of rotary shafts.

16. The apparatus as set forth in claim 4, further comprising:

a carriage, having said print head disposed therein, operatively connected to said print head driving belts.

17. The apparatus as set forth in claim 12, further comprising:

a carriage having said print head disposed therein and operatively connected to said print head driving belts.

18. The apparatus as set forth in claim 1, further comprising:

a flat bed or platen for operatively supporting said substrate during a printing operation.

* * * * *